US010243265B2

(12) United States Patent
Brown et al.

(10) Patent No.: US 10,243,265 B2
(45) Date of Patent: Mar. 26, 2019

(54) WIDE BAND ARRAY ANTENNA

(71) Applicant: The University of Manchester, Manchester (GB)

(72) Inventors: Anthony Keith Brown, Manchester (GB); Yongwei Zhang, Manchester (GB)

(73) Assignee: The University of Manchester, Manchester (GB)

( * ) Notice: Subject to any disclaimer, the term of this patent is extended or adjusted under 35 U.S.C. 154(b) by 0 days.

(21) Appl. No.: 14/910,081

(22) PCT Filed: Aug. 7, 2014

(86) PCT No.: PCT/GB2014/052425
§ 371 (c)(1),
(2) Date: Feb. 4, 2016

(87) PCT Pub. No.: WO2015/019100
PCT Pub. Date: Feb. 12, 2015

(65) Prior Publication Data

US 2016/0190683 A1 Jun. 30, 2016

(30) Foreign Application Priority Data

Aug. 8, 2013 (GB) ..... 1314242.7

(51) Int. Cl.
*H01Q 1/52* (2006.01)
*H01Q 15/24* (2006.01)
(Continued)

(52) U.S. Cl.
CPC ..... *H01Q 1/523* (2013.01); *H01Q 1/36* (2013.01); *H01Q 9/285* (2013.01); *H01Q 15/24* (2013.01);
(Continued)

(58) Field of Classification Search
CPC ..... H01Q 1/523; H01Q 15/24; H01Q 9/285; H01Q 21/062; H01Q 19/00; H01Q 21/24; H01Q 1/36
See application file for complete search history.

(56) References Cited

U.S. PATENT DOCUMENTS 3,681,769 A 8/1972 Perrotti et al.
4,184,163 A 1/1980 Woodward
(Continued)

FOREIGN PATENT DOCUMENTS

CN 102394349 A 3/2012
EP 0325034 A2 7/1989
(Continued)

OTHER PUBLICATIONS

Zhang, Y. and Brown, Anthony, K., "Octagonal Ring Antenna for a Compact Dual-Polarized Aperture Array,"*IEEE Transactions on Antennas and Propagation* 59(10):3927-3932, Oct. 2011.
(Continued)

*Primary Examiner* — Hai V Tran
*Assistant Examiner* — Michael M Bouizza
(74) *Attorney, Agent, or Firm* — Wilmer Cutler Pickering Hale and Dorr LLP

(57) ABSTRACT

An antenna array (106) which in use emits radiation in two respectively orthogonally polarised directions, the array including a plurality of elements, the elements including at least one element of a first type and at least four elements of a second type wherein the element of the first type comprises part of two balanced feeds with two elements of the second type and the element of the first type is capacitively coupled to two further elements of the second type, wherein the elements used to produce radiation in a first direction lie in a first plane (104), the elements used to produce radiation in a second direction lie in a second plane (102), and the first
(Continued)

The unit cell model of the ORA with separated active sheets and a single passive layer (a), Polarisation 1; (b) Polarisation 2.

and second planes are spaced apart, and the element of the first type includes two portions, one of which lies in the first plane and one of which lies in the second plane.

19 Claims, 12 Drawing Sheets

(51) Int. Cl.

| | |
|---|---|
| ***H01Q 21/24*** | (2006.01) |
| ***H01Q 1/36*** | (2006.01) |
| ***H01Q 19/00*** | (2006.01) |
| ***H01Q 9/28*** | (2006.01) |
| ***H01Q 21/06*** | (2006.01) |

(52) U.S. Cl.
CPC ..... *H01Q 19/00* (2013.01); *H01Q 21/062* (2013.01); *H01Q 21/24* (2013.01)

(56) References Cited

U.S. PATENT DOCUMENTS

| | | | | |
|---|---|---|---|---|
| 4,684,954 | A | 8/1987 | Sureau et al. | |
| 4,929,959 | A | 5/1990 | Sorbello et al. | |
| 5,293,176 | A | 3/1994 | Elliot | |
| 5,955,994 | A | 9/1999 | Staker et al. | |
| 6,057,802 | A | 5/2000 | Nealy et al. | |
| 6,300,906 | B1 | 10/2001 | Rawnick et al. | |
| 6,552,687 | B1 | 4/2003 | Rawnick et al. | |
| 6,697,019 | B1 | 2/2004 | Hyuk-Joon et al. | |
| 7,289,064 | B2 | 10/2007 | Cheng | |
| 7,315,288 | B2 | 1/2008 | Livingston et al. | |
| 7,450,071 | B1 | 11/2008 | Volman | |
| 8,947,312 | B2 | 2/2015 | Brown et al. | |
| 2001/0050640 | A1 | 12/2001 | Apostolos | |
| 2003/0132890 | A1 | 7/2003 | Rawnick et al. | |
| 2010/0171675 | A1* | 7/2010 | Borja | H01Q 1/38 343/798 |
| 2012/0146869 | A1 | 6/2012 | Holland et al. | |
| 2012/0146870 | A1* | 6/2012 | Brown | H01Q 19/005 343/795 |

FOREIGN PATENT DOCUMENTS

| | | | |
|---|---|---|---|
| EP | 0688040 | A2 | 12/1995 |
| EP | 1798816 | A1 | 6/2007 |
| GB | 2469075 | A | 10/2010 |

OTHER PUBLICATIONS

Search Report dated Jun. 17, 2009 for GB No. 0905573.2.
International Search Report and Written Opinion dated Jun. 10, 2010 for PCT/GB2010/000642.

* cited by examiner

The unit cell model of the ORA with separated active sheets and a single passive layer (a), Polarisation 1; (b) Polarisation 2.

The reflection coefficient for the two polarisations with 5mm separation and one reflection layer.

New passive layer arrangement for a large separation distance between the radiators of the two polarised elements.

The reflection coefficient for the two polarisations with 10 mm separation and one reflection layer.

Dual polarised array elements are formed on two sides of the same board, with separated passive layer.

The reflection coefficient for the two polarisations with 10 mm separation and two reflection layers.

The reflection rings for the "polarisation 2" is below the active radiator surface for the "polarisation 1."

The mutual coupling between the two polarisations for varying separation distances.

The reflection coefficients of the two polarisations as the separation between them becomes greater for a better isolation performance.

A separated active layer for two polarisations but a single reflection layer

Active layer Polarisation 1; the top reflective layer not shown

Active layer Polarisation 2, and ground plane; the top reflective layer not shown.

A partial, enlarged, view of Figure 14.

WIDE BAND ARRAY ANTENNA

The present invention relates to antennas of the array type and in particular to such antennas which are designed to have a wide usable frequency bandwidth.

There are a large variety of existing microwave antenna designs, including those consisting of an array of flat conductive elements which are spaced apart from a ground plane.

Wide band dual-polarised phased arrays are increasingly desired for many applications. Such arrays which include elements that present a vertical conductor to the incoming fields, often suffer from high cross polarisation. Many system functions have well defined polarisation requirements. Generally, low cross polarisation is desired across the whole bandwidth.

Mutual coupling always occurs in array antennas and it is related to the element type, the element separation in terms of wavelength and the array geometry. It is normally a particular problem in wide bandwidth arrays where grating lobes production must be avoided.

The applicant's own earlier published PCT application WO2010/112857 and UK Patent Application: GB2469075, describe a wide band array which is dual polarised. An example from that patent is shown in FIGS. 1 to 3 and described below.

The isolation between the two polarised elements of an antenna is in general desired to be at least −30 dB for mobile communication application even lower for radio astronomy. A good degree of isolation between the two orthogonally polarised elements of the applicant's earlier design is desirable to achieve these performance requirements for a dual polarised wide band array.

The present invention aims to provide a new array antenna structure which has improved performance over the prior art.

In a broad sense, the aim of the invention is to separate out the two polarised elements of the applicant's earlier design and put them in respectively separate layers, for example on separate sides of a common board or simply spaced apart by a desired distance.

Accordingly, in a first aspect, the present invention provides an improved structure for a better isolation between the dual polarised elements in the aperture array.

Accordingly, there may be provided an antenna array which in use emits radiation in two respectively orthogonally polarised directions, the array including a plurality of elements, the elements including at least one element of a first type and at least four elements of a second type wherein

- the element of the first type comprises part of two balanced feeds with two elements of the second type and
- the element of the first type is capacitively coupled to two further elements of the second type, wherein
- the elements used to produce radiation in a first direction lie in a first plane, the elements used to produce radiation in a second direction lie in a second plane, and the first and second planes are spaced apart, and
- the element of the first type includes two portions, one of which lies in the first plane and one of which lies in the second plane.

A preferred separation between the first and second planes of the antenna array may be between 5 and 25 mm.

A preferred separation between the first and second planes of the antenna array may be between 5 and 10 mm.

There may be provided a second array of elements of the antenna array, the antenna array including one or more signal feeds to only the first array.

the elements of the second array of the antenna array may be arranged in a two planes, wherein those elements of the second array which match the elements of the first array in the first plane lie in a third plane, and those elements of the second array which match the elements of the first array in the second plane lie in a fourth plane.

A preferred separation between the third and fourth planes of the antenna array may be between 5 and 25 mm.

A preferred separation between the third and fourth planes of the antenna array may be between 5 and 10 mm.

The separation between the third and fourth planes of the antenna array may be equal to the separation between the first and second planes.

The antenna array may include further elements of the first type and may be arranged such that each element of the second type is both capacitively coupled to an element of the first type and also forms part of a balanced feed with an element of the first type.

Each element of the second type of the antenna array may be only capacitively coupled to one element of the first type and also forms part of only one balanced feed with an element of the first type.

The elements of the antenna array may be non-dipole in shape.

The elements of the antenna array may be circular or polygonal in shape.

The elements of the antenna array may have an area of non-conductive material in their centres.

The elements of the antenna array may be ring-shaped.

Each element of the antenna array may be shaped as an octagonal ring.

The antenna array may further include a ground plane separated from the planar element array by a layer of dielectric material.

The dielectric material of the antenna array layer may be expanded polystyrene foam.

For each element of the first type of the antenna array, the four elements of the second type associated with it may be spaced equally around it.

The capacitive coupling between elements of the antenna array may be achieved by areas of those elements being interdigitated.

In some embodiments of the present invention, elements of both types have the same physical structure (as will be seen in the figures) but in the present invention the elements are arranged such that they perform the functions of one or the other of the types set out above.

Preferably the array includes further elements. For example, the array may include further elements of the first type and arranged such that each element of the second type is both capacitively coupled to an element of the first type and also forms part of a balanced feed with an element of the first type.

Preferably, each element of the second type is only capacitively coupled to one element of the first type and also forms part of only one balanced feed with an element of the first type.

Preferably the two balanced feeds are positioned perpendicularly to each other, and each feed will produce an independently linearly polarised signal. This is termed a dual-polarised antenna.

Of course in practice such antenna arrays are not infinite in size and at the edges of any array there will be additional elements, for example of a third type. Again, such elements may be identical in physical structure to the elements of the first two types, but by virtue of being at the edges of the array cannot be connected in the same ways.

Generally in an antenna array according to the present invention the four elements of the second type will preferably be spaced equally around the element of the first type with which they are associated.

In some embodiments of the present invention, the capacitive coupling is provided by the inclusion of discrete capacitors. However, in alternative embodiments, the capacitive effect is achieved by interdigitating areas of the respective elements which are being coupled. Preferably the size of the areas being interdigitated and the amount of interdigitation is chosen to provide the desired level of capacitive coupling.

In a further aspect, the present invention provides a method of creating an antenna array including the step of providing elements of the first and second types as previously described and arranging them as also previously described.

Preferably, the elements are non-dipole in shape. More preferably, the elements are circular or polygonal in shape. In some examples, the elements may have an area of non-conductive material in their centres, for example they may be shaped as rings. In preferred embodiments, the elements are shaped as polygonal or octagonal rings.

Generally, the elements according to the present invention are arranged in a planar array. In addition, the array may include a further ground plane which is separated from the element array by a layer of dielectric material. The ground plane may itself take the form of an array of elements similar in structure to the planar element array. The dielectric material may preferably be expanded polystyrene foam.

Embodiments of the present invention will now be described with reference to the accompanying drawings in which.

FIGS. 5*a* and 5*b* show a first embodiment of the present invention.

Figure 5:
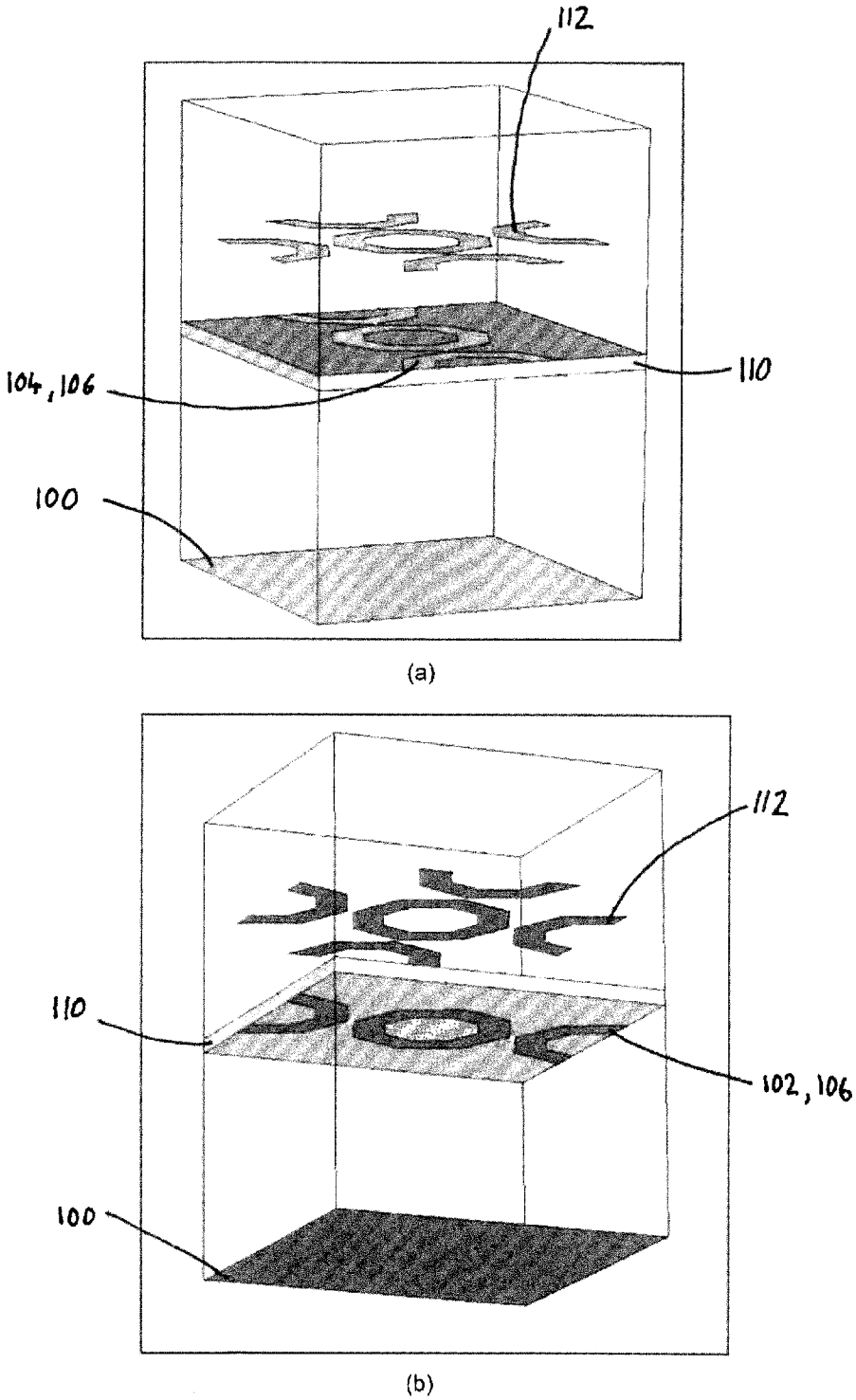
Figure 6:
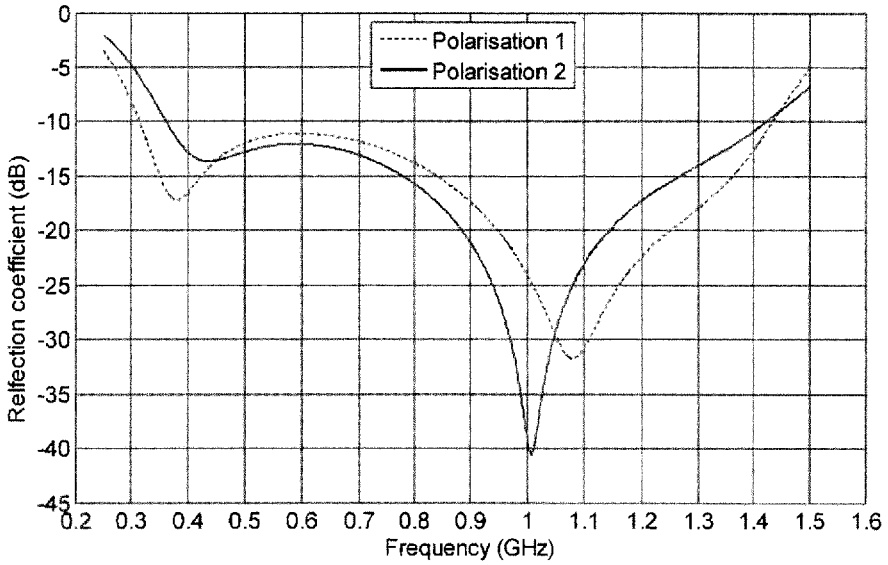

FIG. 6 shows the performance of the design of FIG. 5

FIGS. 7*a* and 7*b* show a further embodiment of the present invention.

Figure 7:
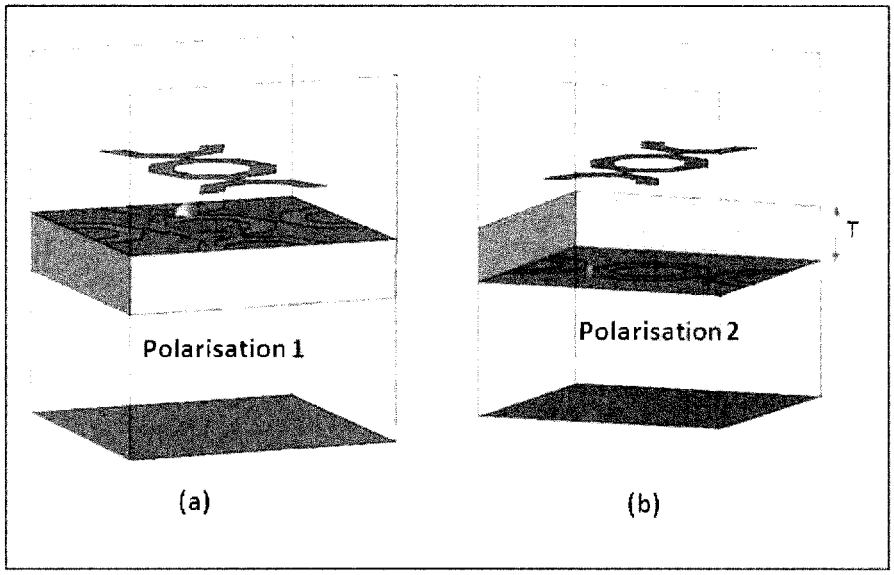
Figure 8:
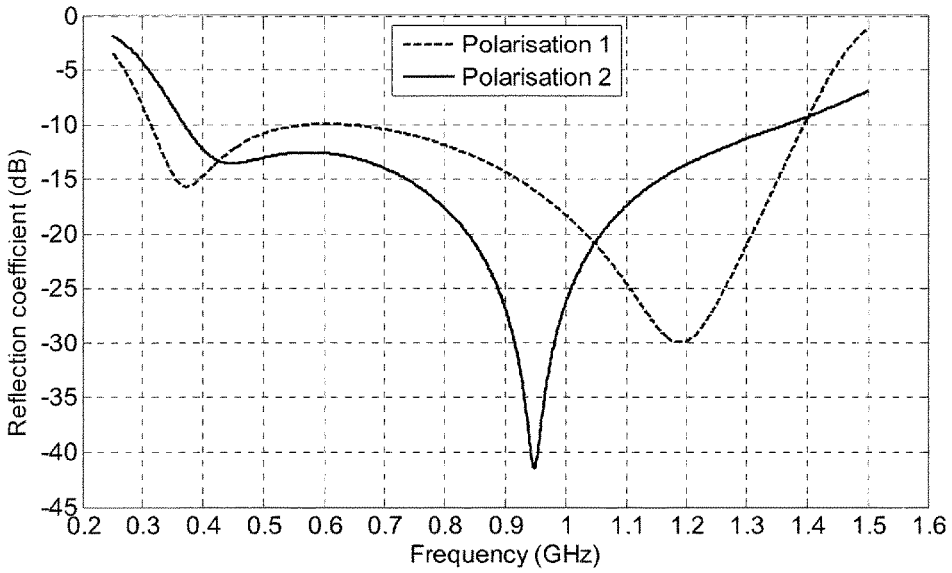

FIG. 8 shows the performance of the design of FIG. 7

FIGS. 9*a* and 9*b* show a further embodiment of the present invention.

Figure 9:
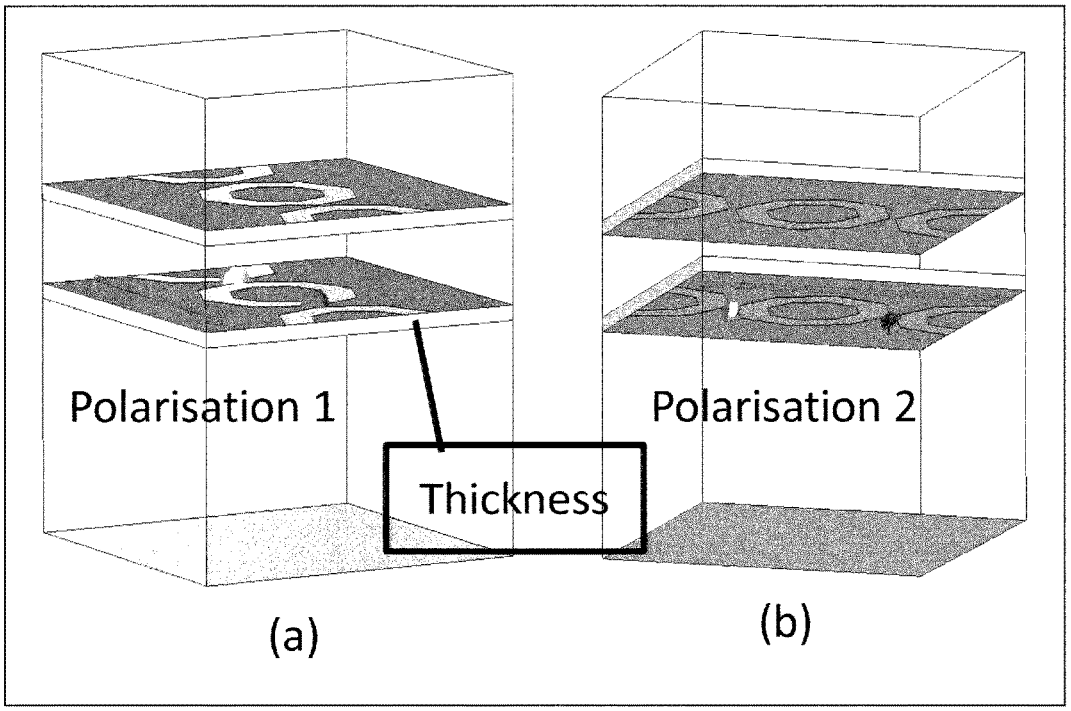
Figure 10:
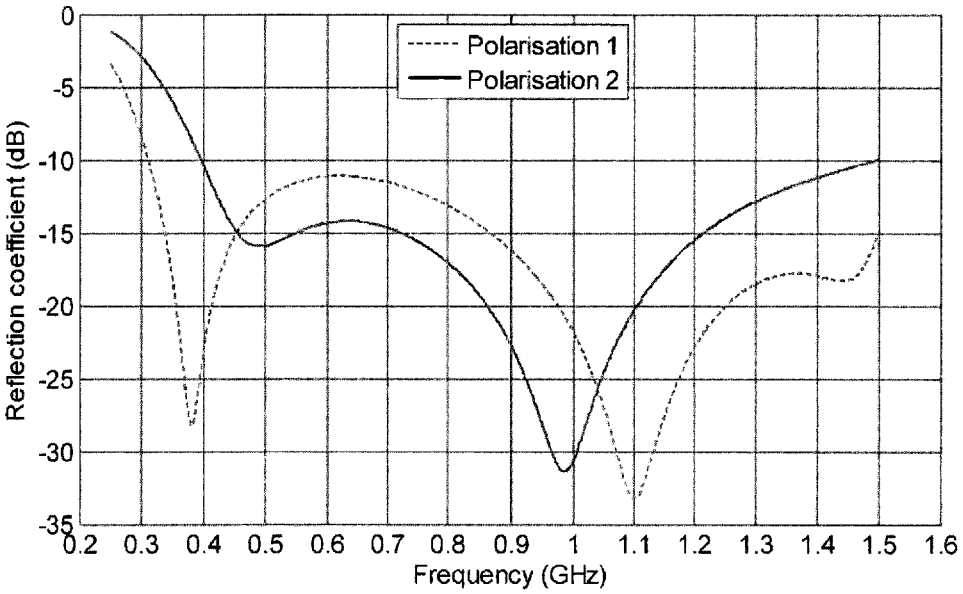

FIG. 10 shows the performance of the design of FIG. 9

Figure 11:
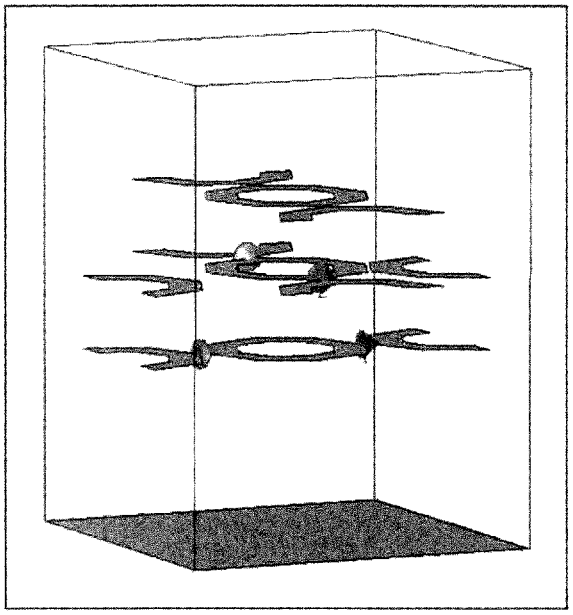

FIG. 11 shows a further embodiment of the present invention.

Figure 12:
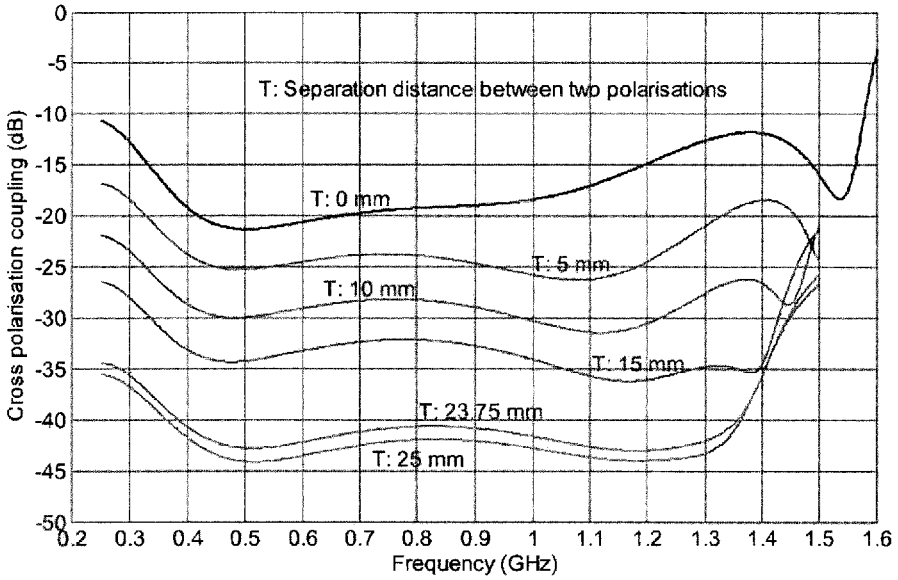
Figure 13:
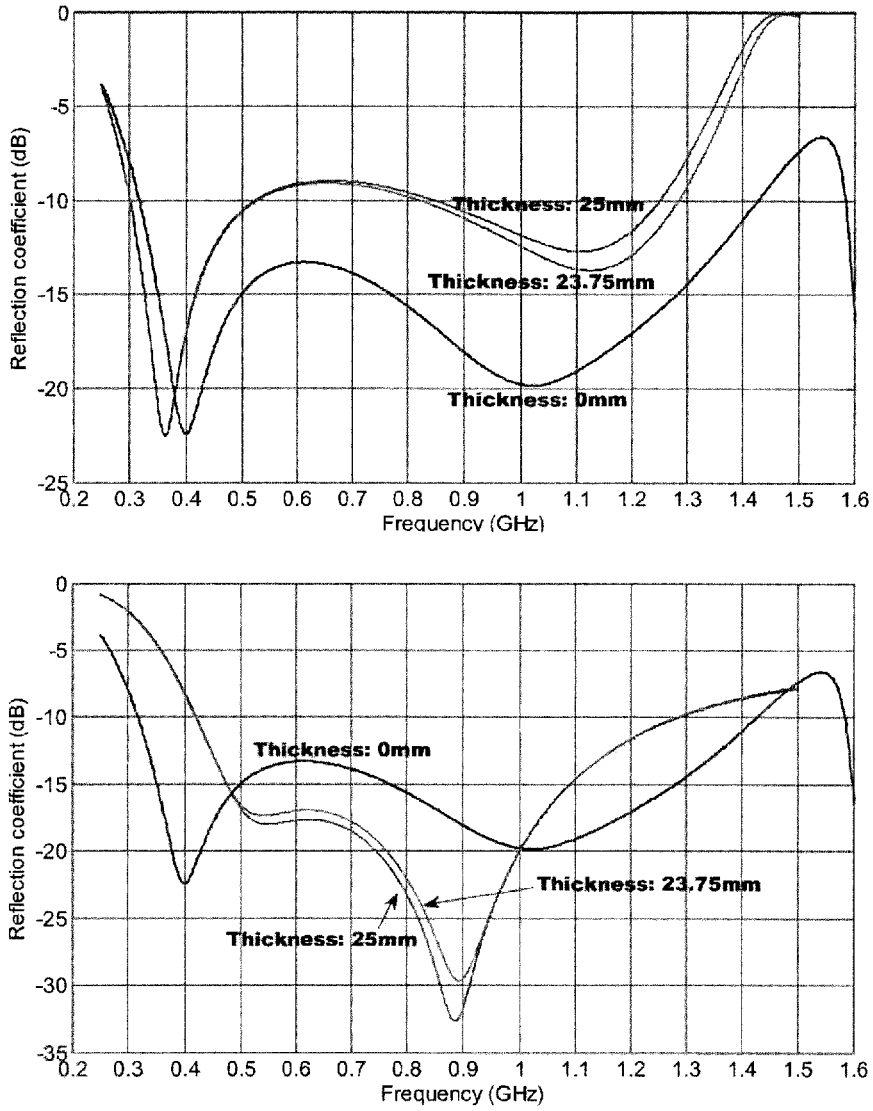

FIGS. 12 and 13 show the performance of the design of FIG. 9 for varying separations.

FIGS. 14 to 17 show the application of the embodiment of FIG. 5 to a larger array.

Figure 1:
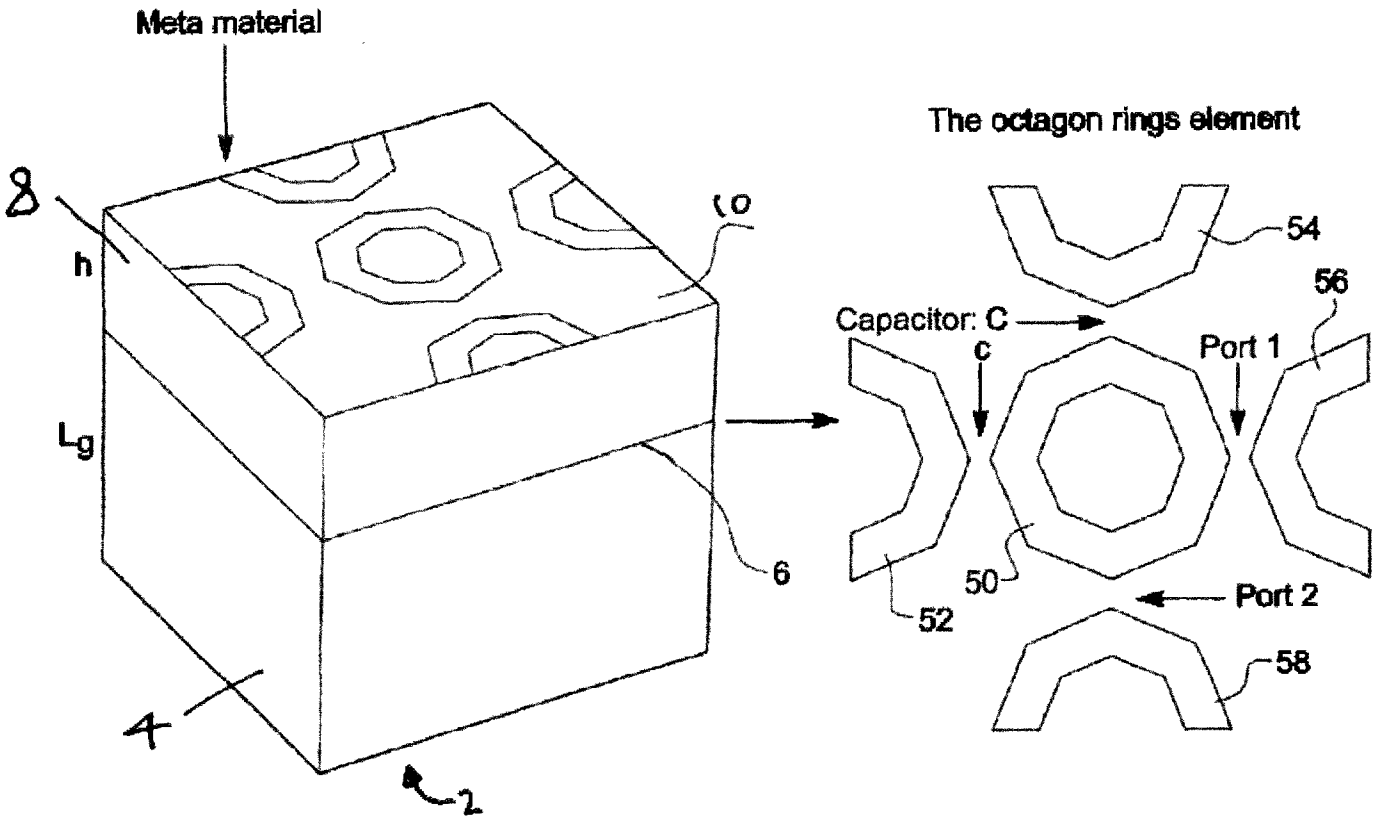
FIG. 1 shows an example of a prior art—"Octagonal Ring antenna" from the applicant's earlier patent utilising "ring" elements which are octagonal.

FIG. 1 shows an embodiment of the applicant's earlier design, utilising octagonal ring-shaped elements. The configuration here consists (from the bottom upwards) of a ground plane 2 (not visible), one layer of dielectric material 4, the main (active) antenna array 6, a further layer of dialectic material 8 and a top (passive) array 10. In the antenna array 6, there is a central element 50 is surrounded by four (preferably equispaced) elements 52, 54, 56, 58. The central element 50 is coupled to elements 52 and 54 (only half of each of which is shown) via respective capacitors C. Also central element 50 forms part (in this case half) of two element pairs with respective elements 56 and 58 (again, only half of elements 56 and 58 are shown). The two element pairs provide ports 1 and 2 for use in the array.

In practice, the arrangement shown in FIG. 1 will form part of a larger array, where the pattern is repeated. This is described more fully later on with reference to FIGS. 2 and 3.

The passive array 10 is optional. It is a conductive layer parallel to and spaced from, the main active antenna element array layer 6. The passive array 10 is a further layer of similar conductive elements to the active array and is preferably arranged with the active array so that the elements of the two arrays are aligned.

Although octagonal ring shaped elements are shown, elements of other shapes e.g. circular or square may be sued instead. Also elements may be solid rather than hollow or ring-shaped.

The hollow or ring-shaped octagonally-shaped elements of FIG. 1 are believed to reduce the coupling between the orthogonal ports in a unit cell. This particular design is referred to in the specification as an "octagon rings antenna" (ORA).

Figure 2:
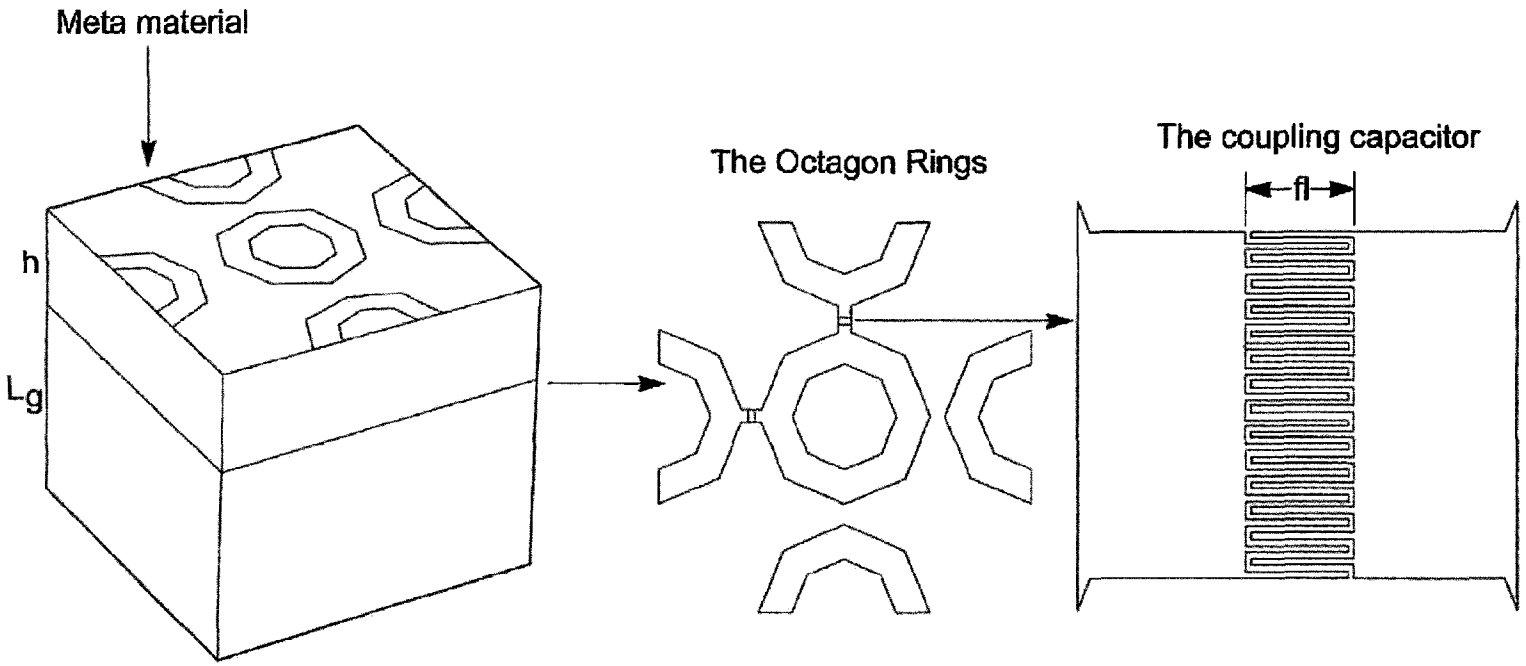
FIG. 2 illustrates the use of inter-digitated coupling capacitors in the design of FIG. 1.

Bulk capacitors may be soldered between the octagonal ring (or other shaped) elements. Alternatively, and preferably, capacitance is provided by interdigitating the spaced apart end portions to control the capacitive coupling between the adjacent ORA elements. The interlaced fingers can replace the bulk capacitors between the elements to provide increased capacitive coupling. For the dual-polarised ORA array with 165 mm pitch size, capacitors of 1 pF are used, for example, each capacitor can be built with 12 fingers with the length of the finger of 2.4 mm. The gap between the fingers is e.g. 0.15 mm. This is shown in FIG. 2. The unit cell configuration is based on h=70 mm, $L_g$=110 mm, sf=0.9.

Figure 3:
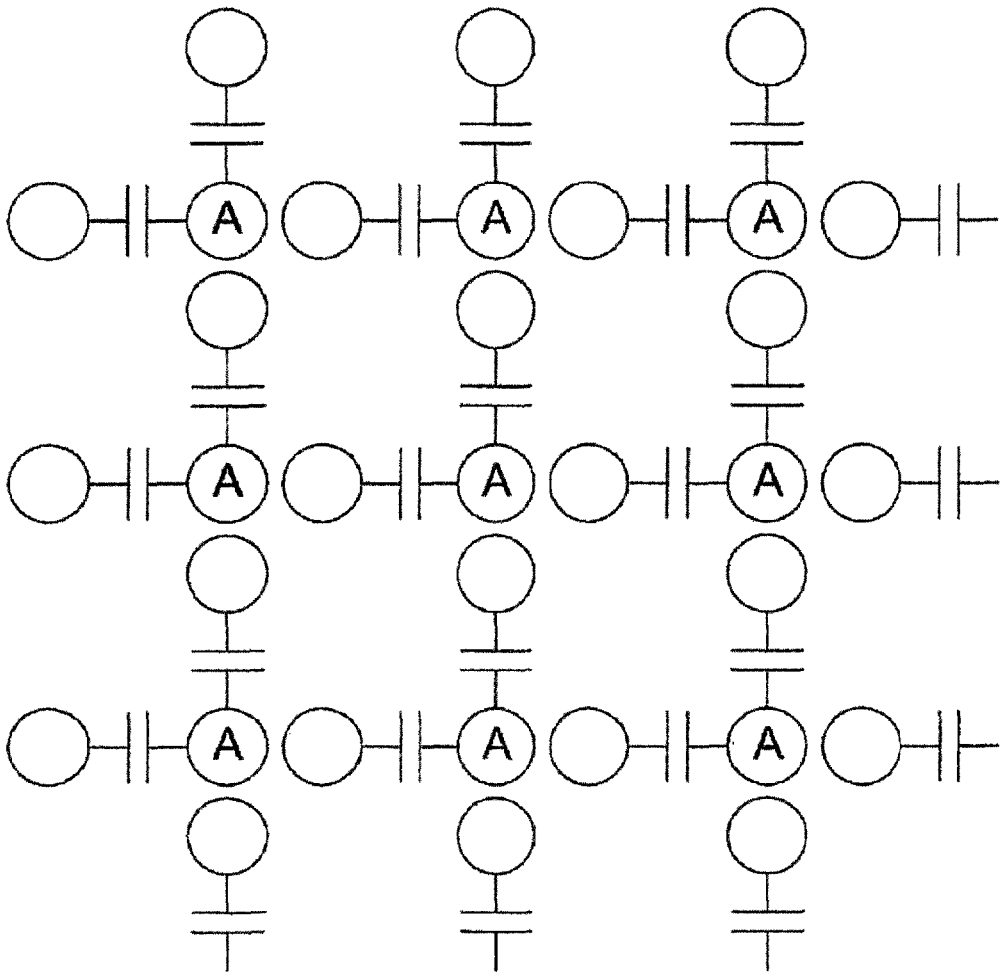
FIG. 3 illustrates a large array made up with general elements according to the present invention.
Figure 4:
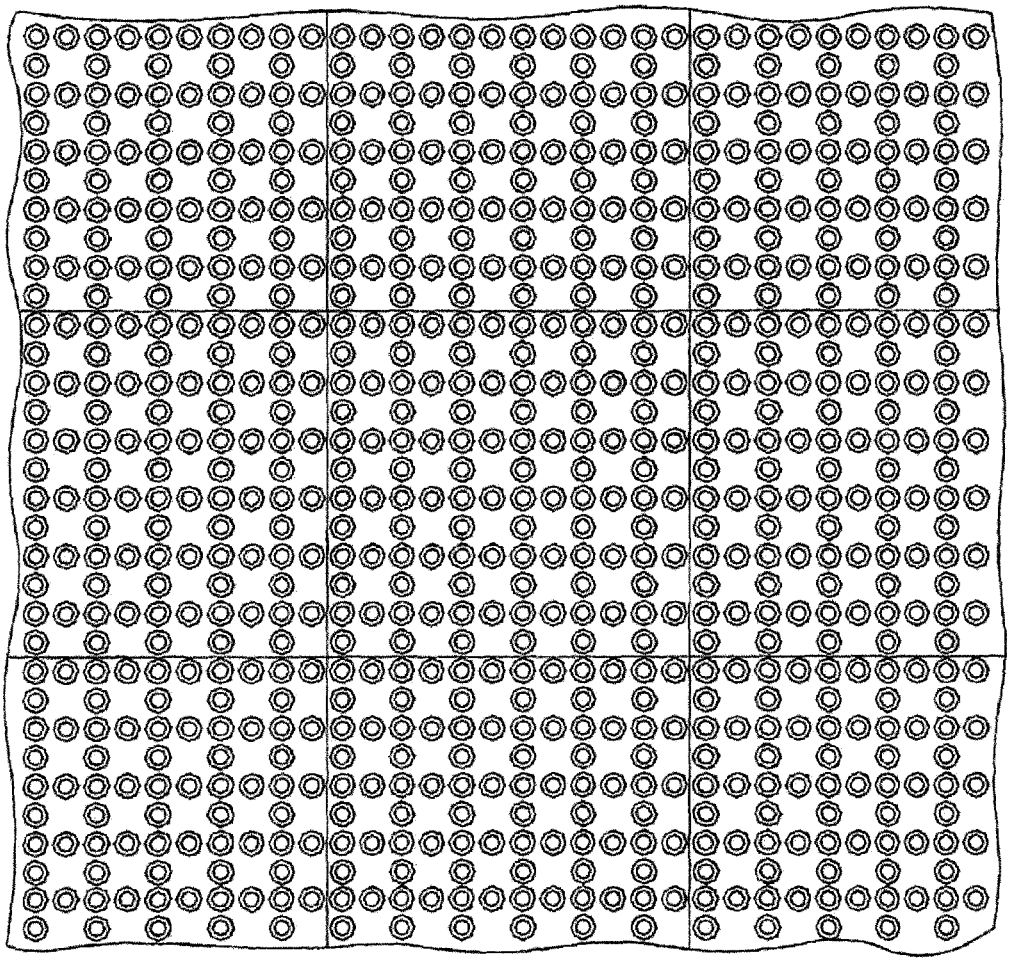
FIG. 4 shows an embodiment of a larger array utilising the design of FIG. 1.

In order to illustrate larger arrays, FIGS. 3 and 4 show examples of such larger repeating arrays. FIG. 3 shows a larger array using elements shown schematically as circular elements As can be readily seen, each individual element of this array is identical to all of the other elements in the array (except of course for the ones at the edges of the array). Generally, each element forms part of a radiating element pair with another such element and also is capacitively coupled to one such element.

FIG. 4 shows a larger array. As can be readily seen, excluding the elements at the edges of the array, the elements not at the edges whilst physically identical can actually be categorised as being of two distinct types. There can be considered to be centre elements (labelled "A") which, as previously described, form part of two dipoles with two other elements and in addition are capactively coupled to two further elements. The other type of element in the array forms part of only one element pair and is capacitively coupled to only one other element. The element spacing is, for example, 165 mm and the capacitance value for the bulk capacitors between the elements is 1 pF.

The active planes of the antennas described above, and of the present invention, can be considered to be 'dual polarised'; that is, they are fed with signal in two directions. The directions as seen in FIGS. 3 and 4 are horizontal and vertical (both in the plane of the paper).

Effectively, the ORA antenna provides two orthogonally polarised sets of elements. In use, these are driven independently and there can be some undesirable mutual coupling between them.

The technique of the present invention is to arrange the components of each of the two polarised elements so that the components of one element are located in a separate plane to the components of the other element. Any components which are common to both elements may be duplicated i.e. included in both planes. One embodiment includes each of the two polarised elements on separate sides of a common dielectric board. This is shown in FIGS. 5*a* and 5*b*.

FIGS. 5*a* and 5*b* show the same structure from two different angles. The dielectric layers are omitted for clarity. A ground plane 100 is spaced from a lower 102 and upper 104 layers of the active array 106, which lower and upper layers are optionally separated by a dielectric layer 110. Lower layer 102 includes elements of the antenna which function in a first polarisation, and upper layer 104 includes elements of the antenna which function in a second polarisation.

Also shown is an optional passive reflective layer 112, located further away from the ground plane than the active antenna layers.

As each active layer is a different distance from the ground plane and the passive layer, their input impedances will be different to each other. For a single passive reflection layer, with a separation between the two active layers of 5 mm, the reflection coefficient for two polarisations is given in FIG. 6.

FIG. 7 shows the same arrangement, but with a larger active layer separation. FIG. 8 shows the corresponding reflection responses, with an active layer separation of 10 mm. It is shown that the input impedances for the two polarisations is significantly different. The reflection coefficients and the resulting input impedances for the two polarisations become more different to each other with increasing layer separation. For a greater separation distance, this difference is even larger.

This variation in input impedance between the two active layers is undesirable. Therefore, a two reflection layer solution is introduced. This is shown in FIG. 9. Effectively, the passive (reflective) layer is separated into its two constituent polarised layers in the same way as the active layer has been split, with one lower passive layer corresponding to the lower active layer, and one upper passive layer corresponding to the upper active layer. This enables the distance between these two pairs of active and passive layers to be kept the same or similar. As a result, the corresponding passive layer rings for the two polarisations are also separated with the same distance as that of the active layer.

FIG. 10 shows the reflection coefficients for an arrangement with two reflection layers and an active layer separation of 10 mm. The input impedance difference between the two polarisations is getting smaller than that with a single reflection layer for the two polarisations.

As the separation of the two active layers increases, then so will the separation of the two passive layers, in order to maintain a uniform distance from the each active radiator layer to the corresponding reflection ring layer for each polarisation. FIG. 11 illustrates this. Unless the distance to the ground plane is increased, in some embodiments an arrangement is possible in which the reflection rings for a first polarisation (the bottom layer of the top passive antenna—"polarisation 2" in FIG. 11) will eventually reach the active radiator surface for the second polarisation (the top layer of the bottom active antenna—"polarisation 1" in FIG. 11). Optionally, for a better cross polarisation isolation performance, as shown in FIG. 11, one reflection ring for the "polarisation 2" is omitted, and the reflection rings for "polarisation 2" could go down to the same surface as the active radiators for the "Polarisation 1," or even below it, as shown in FIG. 11.

As noted above, the isolation between the two polarisations increases as the separation between them becomes greater. The mutual coupling performance between the two polarisations is shown in FIG. 12 for varying distances, based on the embodiment of FIG. 9. The mutual coupling goes close to −45 dB as the separation distance reaches T=25 mm.

It is noted that as the distance T between the two polarisations reaches a certain value, such as T=23.75 mm, the reflection rings for the "polarisation 2" will be in the same surface as the radiators for the "polarisation 1." The mutual coupling between the two polarisations goes below −40 dB as the separation distance T is greater than 20 mm. However, the distances from the radiators of the two polarisations to the common ground plane will be different; as a result, the input impedances for the two polarised elements are not identical. This is shown in FIG. 13. But when the separation is as small as 5 mm, the input impedance for the two polarisations are still approx. the same.

FIGS. 14 to 17 illustrate the application of the above principles to larger arrays. All show the embodiment of two active layers and one passive layer, but would be equally applicable to the use of the dual (split) passive layers.

Figure 14:
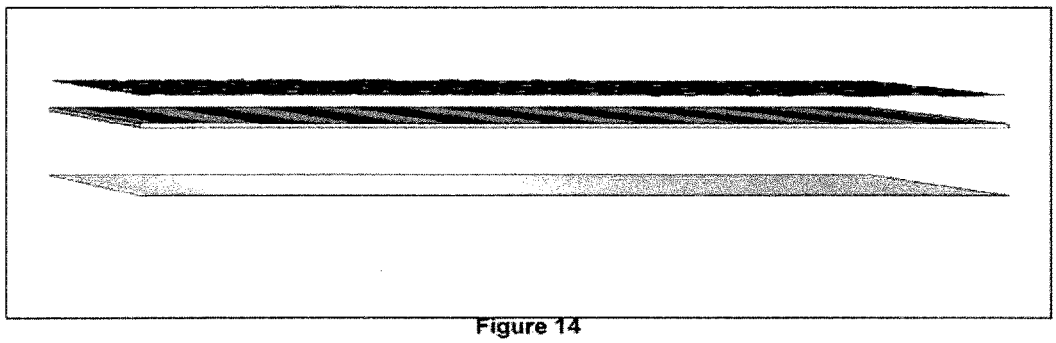
Figure 15:
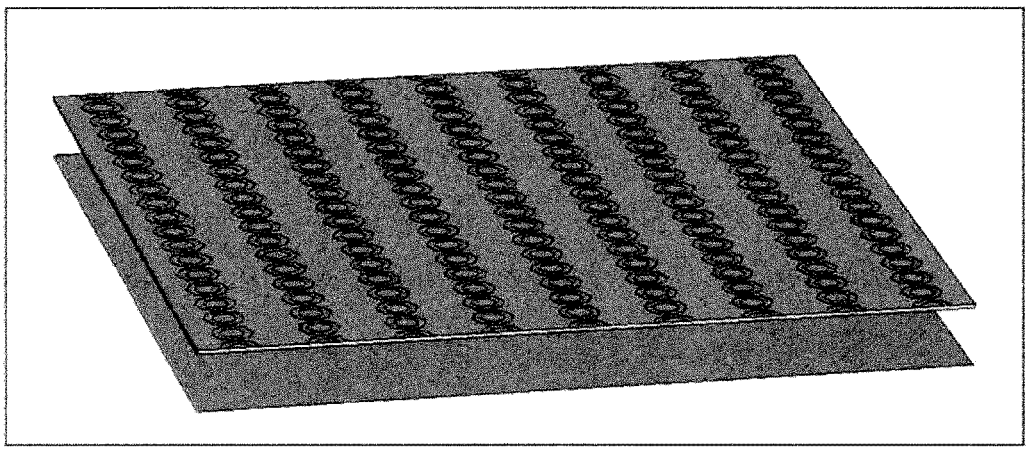
Figure 16:
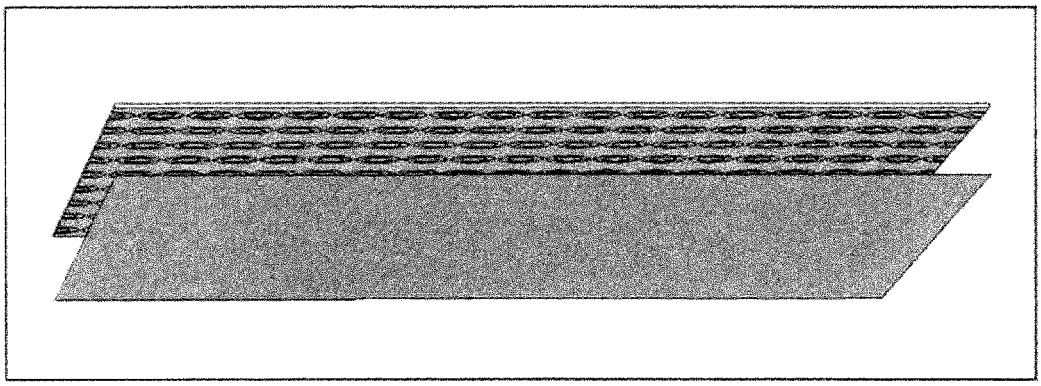
Figure 17:
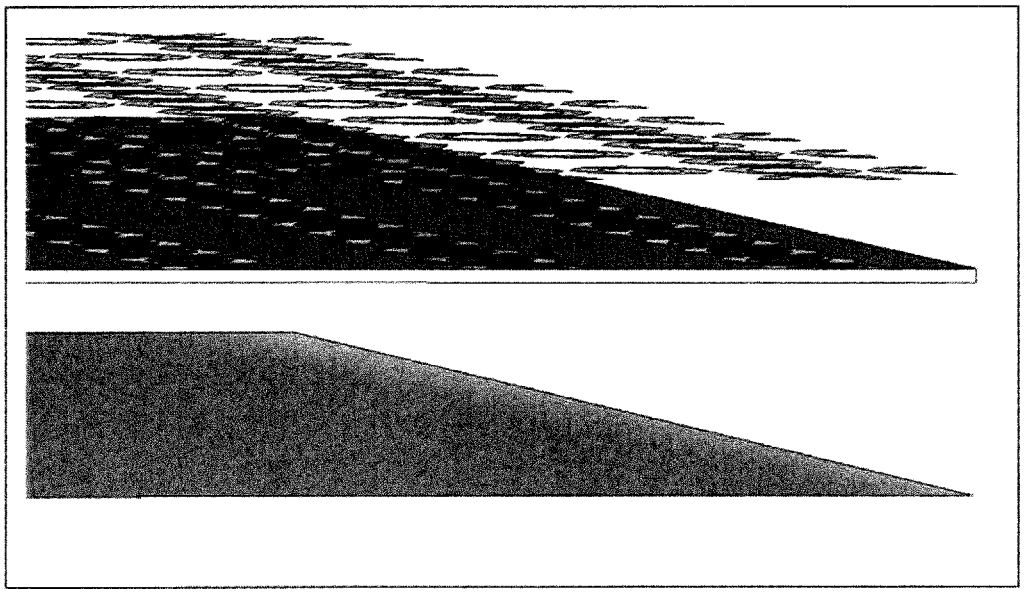

FIG. 14 shows a dual active layer for two polarisations but a single reflection layer, and FIG. 17 shows a partial, enlarged, view of FIG. 14. FIG. 15 shows the active layer Polarisation 1; and FIG. 16. shows the active layer polarisation 2, with ground plane. In both FIGS. 15 and 16; the top reflective layer not shown.

In conclusion, by separating the two polarisation elements with a fixed distance, the mutual coupling between the two polarised elements in the aperture array can be significantly reduced from −15 dB without a separation to below −40 dB with a distance of 20-25 mm. This is significant in applications such as mobile communications and radio astronomy.

The present invention has been described with reference to preferred embodiments. Modifications of these embodiments, further embodiments and modifications thereof will be apparent to the skilled person and as such are within the scope of the invention.

The invention claimed is:

1. An antenna array which in use emits radiation in two respectively orthogonally polarised directions, the array including a plurality of elements, the elements including at least one element of a first type and at least four elements of a second type wherein the element of the first type comprises part of two balanced feeds with two elements of the second type and the element of the first type is capacitively coupled to two further elements of the second type, wherein the elements used to produce radiation in a first direction lie in a first plane, the elements used to produce radiation in a second direction lie in a second plane, and the first and second planes are spaced apart, and the element of the first type which comprises part of two balanced feeds with two elements of the second type includes two portions, a first portion of which lies in the first plane and a second portion of which lies in the second plane, wherein the second portion of the element of the first type lying in the second plane duplicates and lies directly above the first portion of the element of the first type lying in the first plane.

2. An antenna array according to claim 1 wherein the preferred separation between the first and second planes is between 5 and 25 mm.

3. An antenna array according to claim 1 wherein the preferred separation between the first and second planes is between 5 and 10 mm.

4. An antenna array according to claim 1 further including a second array of elements, the antenna array including one or more signal feeds to only the first array.

5. An antenna array according to claim 4 wherein the second array provides a passive reflective layer which is located further away from a ground plane than the first array, wherein elements of the second array match the elements of the first array and are arranged in two planes, wherein those elements of the second array which match the elements of the first array in the first plane lie in a third plane, and those elements of the second array which match the elements of the first array in the second plane lie in a fourth plane.

6. An antenna array according to claim 5 wherein the preferred separation between the third and fourth planes is between 5 and 25 mm.

7. An antenna array according to claim 5 wherein the preferred separation between the third and fourth planes is between 5 and 10 mm.

8. An antenna array according to claim 5 wherein the separation between the third and fourth planes is equal to the separation between the first and second planes.

9. An antenna array according to claim 1 including further elements of the first type and arranged such that each element of the second type is both capacitively coupled to an element of the first type and also forms part of a balanced feed with an element of the first type.

10. An antenna array according to claim 9 wherein each element of the second type is only capacitively coupled to one element of the first type and also forms part of only one balanced feed with an element of the first type.

11. An antenna array according to claim 1 wherein the elements are non-dipole in shape.

12. An antenna array according to claim 11 wherein the elements are circular or polygonal in shape.

13. An antenna array according to claim 12 wherein the elements have an area of non-conductive material in their centres.

14. An antenna array according to claim 13 wherein the elements are ring -shaped.

15. An antenna array according to claim 14 wherein each element is shaped as an octagonal ring.

16. An antenna array according to claim 1 further including a ground plane separated from the planar element array by a layer of dielectric material.

17. An antenna array according to claim 16 wherein the dielectric material layer is expanded polystyrene foam.

18. An antenna array according to claim 1 wherein for each element of the first type the four elements of the second type associated with it are spaced equally around it.

19. An antenna array according to claim 1 in which the capacitive coupling between elements is achieved by areas of those elements being interdigitated.

* * * * *